US008426349B2

(12) United States Patent
Monken

(10) Patent No.: US 8,426,349 B2
(45) Date of Patent: Apr. 23, 2013

(54) CHLORINATED ALKALINE PIPELINE CLEANER WITH METHANE SULFONIC ACID

(75) Inventor: Alan Monken, Overland Park, KS (US)

(73) Assignee: DeLaval Holding AB, Tumba (SE)

( * ) Notice: Subject to any disclaimer, the term of this patent is extended or adjusted under 35 U.S.C. 154(b) by 0 days.

(21) Appl. No.: 12/475,238

(22) Filed: May 29, 2009

(65) Prior Publication Data

US 2010/0305017 A1 Dec. 2, 2010

Related U.S. Application Data

(60) Provisional application No. 61/181,174, filed on May 26, 2009.

(51) Int. Cl.
*C11D 3/395* (2006.01)
*C11D 7/08* (2006.01)

(52) U.S. Cl.
USPC ..... 510/218; 510/234; 510/253; 510/269; 510/272; 510/367; 510/379; 510/380; 510/495

(58) Field of Classification Search ..... 510/210, 510/218, 234, 253, 269, 272, 367, 379, 380, 510/495
See application file for complete search history.

(56) References Cited

U.S. PATENT DOCUMENTS

| | | | | | |
|---|---|---|---|---|---|
| 3,998,945 | A | * | 12/1976 | Vit | 424/53 |
| 4,228,048 | A | * | 10/1980 | Tesdahl | 524/166 |
| 4,352,678 | A | * | 10/1982 | Jones et al. | 510/369 |
| 4,680,134 | A | * | 7/1987 | Heile et al. | 510/379 |
| 4,695,394 | A | * | 9/1987 | Choy et al. | 510/369 |
| 4,699,728 | A | | 10/1987 | Riehm et al. | |
| 5,554,321 | A | * | 9/1996 | Choy et al. | 510/398 |
| 5,767,055 | A | * | 6/1998 | Choy et al. | 510/406 |
| 5,821,214 | A | * | 10/1998 | Weibel | 510/368 |
| 5,833,764 | A | * | 11/1998 | Rader et al. | 134/22.11 |
| 5,985,817 | A | * | 11/1999 | Weibel et al. | 510/369 |
| 6,051,676 | A | * | 4/2000 | Sirianni | 528/196 |
| 6,294,511 | B1 | * | 9/2001 | Argo et al. | 510/238 |
| 6,303,564 | B1 | * | 10/2001 | Littau et al. | 510/505 |
| 6,539,954 | B1 | * | 4/2003 | Schimmel et al. | 134/25.3 |
| 6,992,053 | B2 | * | 1/2006 | Cermenati et al. | 510/238 |
| 7,611,588 | B2 | * | 11/2009 | Peitersen et al. | 134/26 |
| 2001/0009897 | A1 | * | 7/2001 | Bauer et al. | 510/511 |
| 2003/0040458 | A1 | | 2/2003 | Olson et al. | |
| 2005/0032667 | A1 | * | 2/2005 | Norenberg et al. | 510/480 |
| 2006/0240672 | A1 | * | 10/2006 | Yoneda et al. | 438/692 |
| 2008/0087644 | A1 | * | 4/2008 | Nishioka et al. | 216/89 |
| 2009/0247485 | A1 | * | 10/2009 | Ahmed et al. | 514/54 |
| 2010/0224221 | A1 | * | 9/2010 | Neplenbroek et al. | 134/25.2 |

FOREIGN PATENT DOCUMENTS

| | | | |
|---|---|---|---|
| KR | 10-2000-0049238 | A | 7/2000 |
| KR | 10-2003-0096491 | A | 12/2003 |

OTHER PUBLICATIONS

International Search Report and Written Opinion dated Dec. 22, 2010 for PCT International Application No. PCT/US2010/036087, filed May 25, 2010; Applicant: Delaval Holding AB et al. (12 pages).

* cited by examiner

*Primary Examiner* — Charles Boyer
(74) *Attorney, Agent, or Firm* — Hovey Williams LLP

(57) ABSTRACT

A chlorinated alkaline cleaning agent and methods for removing food soils with no resultant increase in foam generation. Particularly advantageous is that the addition of methanesulfonic acid in removing food soils with no resultant increase in foam generation.

26 Claims, No Drawings

CHLORINATED ALKALINE PIPELINE CLEANER WITH METHANE SULFONIC ACID

RELATED APPLICATIONS

This application claims priority to U.S. Patent Application Ser. No. 61/181,174 filed May 26, 2009, which is incorporated herein by reference.

BACKGROUND

Food soils are the result of adhesive bonds between food and surface substrates such as, for example, stainless steel, glass, plastic and aluminum. Carbohydrates, fats, proteins, and mineral salts from food sources contribute to the deposition of food soils on surfaces. Milk, for example, typically contains inorganic cationic salts of various minerals such as calcium, magnesium and iron together with such anions as carbonate, sulfate and oxalate. Bicarbonates, sulfates, and chlorides of calcium or magnesium present in hard water can neutralize detergents, decrease rinsability and create films on equipment. Mineral precipitation contributes to the disadvantageous effects of food soil deposition on various types of systems including, for example, food processing equipment (milking equipment, evaporators, fermentors) and warewashers and household appliances.

The most common deposits forming in food processing applications are typically comprised of some combination of starches and sugars, oils and fats, and proteinaceous materials. These deposits become difficult to remove when subjected to high temperatures, as heat can partially degrade the chemical structure of fats and proteins, reducing their solubility in water. Milk soils commonly occurring in dairy processing applications, consist primarily of butterfat, whey proteins, and lactose sugars. These soils can be particularly challenging to remove, as the components, primarily the fat and protein, require significantly different chemical approaches for removal from equipment surfaces.

The presence of food soils and precipitates in pipelines, for example, can increase system operating costs by reducing liquid flow, expediting corrosion, fostering the growth of bacteria and algae, and acting as an insulating layer that diminishes heat transfer. While all of these factors are deleterious, the problem of inefficient heat transfer is compounded by the fact that soils build quickly near heated surfaces where concentrations of cations and anions become supersaturated.

chlorinated alkaline detergents used, for example, to clean food processing equipment, normally consist of a blend of sodium hypochlorite, sodium hydroxide, and water conditioning agents to improve cleaning efficacy in hard water. The formulas are most frequently circulated for clean-in-place (CIP) cleaning and are required to be low or no foaming. Surfactants such as non-ionic and anionic detergents reduce the surface tension of liquid and substantially increase the effectiveness of the cleaning process. However, the use of conventional surfactants, in conjunction with standard chlorinated alkaline detergents results in a physical incompatibility by generating foam. Additionally for formulation into concentrated chlorinated alkaline detergents, most surfactants are incompatible with either the strong alkaline, basic conditions or high electrolyte content, or react with the hypochlorite. The production of foam can be deleterious for certain applications such as clean in place formulations. Production of foam interferes with equipment function by, for example, clogging pipelines, creating pressure variations, and by remaining in the system for extended periods of time.

SUMMARY

As used herein "food soils" such as milk films, also referred to as "polymerized food soils" or "soils" may be the result of cooked-on soils, baked-on soils, or burnt-on soils. "Soils" may also result from raw or unprocessed organic materials.

As used herein, "ready to use" means that the composition may be used directly without dilution or with addition of ancillary components.

The presently disclosed instrumentalities overcome the problems outlined above and advance the art by providing compositions and methods for removing food soils, and milk soils and to reduce or prevent precipitates with no resultant increase in foam generation.

In an embodiment, between about 0 ml and 5 ml of foam is generated per 100 ml of a use dilution. Preferably no foam is generated per 100 ml of a use dilution.

In an embodiment, foam collapse occurs between about 0 minutes and 5 minutes of foam generation. Preferably foam collapse occurs between about 0 minutes and about 1 minutes of foam generation.

The presently disclosed instrumentalities may also be used to improve cleaning in applications where foam is tolerated or desired.

In one embodiment, the addition of alkyl sulfonic acid, especially methane sulfonic acid to a chlorinated alkaline cleaner provides an improvement in cleaning with no resultant increase in foam generation or mineral precipitation. Alkyl sulfonic acids may be selected from the C1-8 sulfonic acids. The sodium or potassium methane sulfonate salt formed in situ proves not only to be unaffected by sodium or potassium hypochlorite but also has no deleterious effects on chlorine levels. Improvements to overall cleaning efficiency as well as cleaning at reduced temperatures can be achieved using an alkyl sulfonate such as either methane sulfonic acid (MSA) alone or a combination of MSA and a alkaline soluble, chlorine stable surfactant such as alkyl diphenyl oxide disulfonate.

In an embodiment, compositions for removing food soils, especially milk soils and/or inhibiting formation thereof include an alkaline agent, a scale and corrosion inhibitor, an acrylic sodium salt polymer, methyl sulfonic acid, a surfactant, a sodium polyphosphate and strong base.

In an embodiment, the multifunctional cleaning composition comprises an alkaline agent that may be selected from the group consisting of sodium hydroxide, potassium hydroxide, silicates, including sodium meta silicate, sodium or potassium carbonate, sodium or potassium bicarbonate and combinations thereof. The alkaline agent may be present in a concentration range of about 4.0% to about 95.0% by weight.

In an embodiment, the multifunctional cleaning composition may comprise one or more hypochlorite agents present in a concentration of about 0.1% to about 8.0% by weight. The hypochlorite may be, for example, sodium hypochlorite or potassium hypochlorite. Sources of chlorine may derive from solids such as dichloro-isocyanurate, trichloro-isocyanurate and calcium hypochlorite.

In a preferred embodiment, the multifunctional cleaning composition may comprise one or more hypochlorite agents present in a concentration of about 0.5% to about 5.0% by weight.

In an embodiment the multifunctional cleaning composition comprises an alky sulfonic acid or the alkaline earth metal salt thereof and combinations thereof and may be present in a concentration range of about 0.1% to about 10.0% by weight.

In a preferred embodiment the multifunctional cleaning composition comprises an alky sulfonic acid or the alkaline earth metal salt thereof and combinations thereof, and may be present in a concentration range of about 0.2 to about 5.0% by weight.

In a most preferred embodiment the multifunctional cleaning composition comprises an alky sulfonic acid or the alkaline earth metal salt thereof and combinations thereof and may be present in a concentration range of about 0.5 to about 5.0% by weight.

In an embodiment, the multifunctional cleaning composition comprises one or more additional alkaline agents may be used present in a concentration of about 1.0% to about 60% by weight.

In an embodiment, the multifunctional cleaning composition may comprise a surfactant and may be present at a concentration from about 0.05% to about 5.0% by weight. The surfactant may be, for example, alkyl diphenyl oxide disulfonate.

In an embodiment, the multifunctional cleaning composition may comprise a scale and/or corrosion inhibitor such as 2-phosphonobutane-1,2,4-tricarboxylic acid tetrasodium salt and present in a concentration range from about 0.10% to about 10% by weight.

In an embodiment, the multifunctional cleaning composition may comprise a threshold inhibiting agent such as an acrylic salt polymer. The acrylic salt polymer may be but not limited to sodium polyacrylate and may be present at a concentration range from about 0.1% to about 10% by weight.

In an embodiment, the multifunctional cleaning composition may comprise a polymer or copolymers of a thickening agent or agents such as a polysaccharide including, starches and vegetable gums. Thickening agents may further include ethylene polymers such as polyethylene glycol. Additional thickening agents may include, polyacrylamides. Thickening agents may be present at a concentration range from about 0.1% to about 10% by weight.

In yet a another embodiment, the multifunctional cleaning composition may comprise a polyphosphate such as sodium tripolyphosphate, sodium hexameta phosphate, or tetra potassium pyrophosphate and present at a concentration from about 0.1% to about 7.0% by weight.

In an embodiment, methods for removing food soils from equipment are disclosed. The methods include contacting equipment with a use dilution of the multifunctional cleaning composition, derived from a stable concentrate having a pH range from 8-14, preferably between 10 and 13.

In yet another embodiment, treatment times may be between about 0.1 to 20 minutes, between about 2 to 10 minutes and between about 4 to 8 minutes. In a preferred embodiment, surfaces are treated for about 8 minutes.

DETAILED DESCRIPTION

A multifunctional cleaning composition that contains an alkyl sulfonic acid is described. One or more of a scale and corrosion inhibitor, an alkaline agent, an acrylate polymer, a surfactant, an alkyl sulfonic acid, a polyphosphate, and a hypochlorite may be included. The relative percentages of different ingredients in the teaching below serves as guidance. Slight variation may be tolerated without departing from the spirit of the invention.

The term "surfactant" may refer to organic compounds that are amphipathic, which means that the same molecule contains both a hydrophobic and a hydrophilic group. The hydrophilic group is customarily called the "head" of the surfactant, while the hydrophobic group referred to as the "tail." By way of functional definition, a surfactant generally reduces the surface tension between two phases. A surfactant may be classified according to the presence or absence of a charged group in the head. A non-ionic surfactant has no charge group in its head, while the head of an ionic surfactant generally carries a net charge. A surfactant with a head that carries both a positively and a negatively charged group is termed a zwitterionic or amphoteric surfactant.

Suitable surfactants for the disclosed composition may be anionic, non-ionic, cationic or amphoteric surfactants. Surfactants wet the surface of application, reduce surface tension of the surface of application so that the product can penetrate easily on the surface and remove unwanted soil. The surfactants of the formulation increase overall detergency of the formula, solubilize or emulsify some of the organic ingredients that otherwise would not dissolve or emulsify, and facilitate penetration of active ingredients deep onto the surface of the intended application surfaces.

In various aspects, suitably effective surfactants may include anionic, cationic, nonionic, zwitterionic and amphoteric surfactants. Suitable anionic surfactants can be chosen from alkyl sulfonic acid, alkyl sulfonate salt, linear alkylbenzene sulfonic acid, a linear alkylbenzene sulfonate, an alkyl α-sulfomethyl ester, an α-olefin sulfonate, an alcohol ether sulfate, an alkyl sulfate, an alkylsulfo succinate, a dialkylsulfo succinate, and their alkali metal, alkaline earth metal, amine and ammonium salts thereof. Additional surfactants may include non ionic biodegradable surfactants such as ™NDG-77, and amphoteric low foaming surfactants such as Burcoterge™ HCS-50NF. Additional surfactants may also include, sodium alkanoate, modified polyethoxylated alcohol, octylamine oxide, sodium xylene sulfonate, para toluene sulfonic acid.

When combined with an alkali metal component, such as, but not limited to sodium hydroxide and potassium hydroxide, an alkyl sulfonic acid becomes neutralized, forming the sodium or potassium salt of the alkyl sulfonic acid. For example, methane sulfonic acid, in the presence of sodium hydroxide forms its alkali metal salt, sodium methanesulfonate, whereas methane sulfonic acid, in the presence of potassium hydroxide will form potassium methanesulfonate.

Sodium or potassium alkyl sulfonates, such as sodium or potassium methane sulfonate, may function as hydrotropes to solubilize hydrophobic compounds in aqueous solutions. This is the mechanism observed in the disclosed instrumentalities, as the addition of an alkyl sulfonic acid to an alkaline solution forms its neutralized sodium salt, sodium or potassium alkyl sulfonate. This helps to solubilize the hydrophobic soils, such as milk fat, to facilitate cleaning of the equipment.

A disulfonate based ionic surfactant or a non-ionic surfactant is preferred. One example of a disulfonate based surfactant includes, but is not limited, to alkyl diphenyl oxide disulfonate.

Chelating agents may be used to inactivate certain metal ions in order to prevent the formation of precipitates or scale. Suitable chelating agent for use with the following formulation may be, for example, sodium gluconate and sodium glucoheptonate.

Thresholding agents (threshold inhibiting agents) or scale inhibitors may be used to inhibit crystallization of water hardness ions (e.g., calcium containing salts) from solution. In various aspects thresholding agents and/or scale inhibitors for use with the following formulations may include, but are not limited to, sodium polyacrylate (Goodrite K7058N, Sokalan PA 25 CL PN, Acusol 445), 2-Phosphonobutane-1, 2,4-tricarboxylic acid (Bayhibit AM, Bayhibit N, Dequest 7000), phosphonates (Dequest FS) or 1-Methylglycin-N,N-Diacetic Acid, Sodium Salt (Trilon M).

The alkaline agent is a component that when mixed with the pipeline cleaner solution is effective to raise the pH of the admixture into the range of from about 8 to 14. The alkaline agent includes a metal hydroxide, such as potassium hydroxide or sodium hydroxide or both.

The pH value of the composition may be adjusted by the addition of acidic or basic or buffering materials. Generally, a basic pH is preferred for alkaline pipeline cleaners. Suitable bases for use as pH adjusting agents may include, sodium hydroxide, ammonium hydroxide, potassium hydroxide, sodium carbonate, or sodium bicarbonate, or combinations thereof.

Silicates may also be used to adjust the pH value of the composition. The alkalinity of sodium silicates, for example, enables the to neutralization of acidic soils, emulsification of fats and oils, and dispersion or decomposition of proteins. Silicates have a buffering capacity stronger than most alkaline salts that contributes to the maintenance the desired pH in the presence of acidic compounds or in dilution.

The pH range of the composition is greater than 8 and from about 8 to 14, preferably between about 10 and 13 and most preferably between about 11 to 13 for use in multifunctional cleaning composition formulations.

Compositions for removing food soils may be manufactured and/or supplied as "ready to use" formulations or as concentrates for dilution. Compositions for removing food soils may further be supplied or manufactured in liquid, slurry, gel, powder and other physical forms. Concentrated liquid or powder forms, i.e. concentrates, can be dissolved or dispersed in a solvent to form a reconstituted solution, typically referred to as a "use dilution". A typical range of use dilution for effective use is between about 0.25% wt/wt to about 0.75% wt/wt. Although a broader ranges for example, between about 0.1% wt/wt to about 2.0% wt/wt and between about 2.0% wt/wt to about 99% wt/wt may also be employed.

As used herein, a "stable concentrate" is a homogeneous solution or dispersion that maintains at least 90% of its maximum efficacy for at least thirty days, preferably for at least sixty days and more preferably for at least ninety days. The components of a stable concentrate do not degrade, decompose, denature, separate or otherwise rearrange to cause significant reduction in the ability of a use dilution of the stable concentrate to clean food soils, prevent foaming or remove precipitate or inhibit formation thereof. Typically, a stable solution may be stored for at least thirty days at a temperature of between about 15° C. and 30° C. Storage is preferably carried out in the absence of sunlight. Generally stable liquid concentrates contain a solvent such as water and/or another solvent.

The present compositions may be used in a temperature range between 5° C. and 90° C. Typical temperatures of use are around 25° C. to 80° C., around 40° C. to 80° C. and around 40° C. to 60° C.

The present compositions may be used to treat stainless steel and other surfaces including, but not limited to, glass, rubber and plastic. The compositions can be used, for example, on milking machines or where food is processed at low temperatures. The compositions may, for example, be used where heat has fused protein, fat, carbohydrate, mineral (e.g., calcium phosphate, calcium sulfate, calcium carbonate) and/or organometallic compounds (e.g., calcium citrate, calcium lactate, calcium oxalate) onto the surface of processing equipment. Processes utilizing heat in the presence of such substances include, for example, the use of evaporators, dryers, high temperature/short time pasteurizers (HTST's), batch pasteurizers, high temperature units (UHT units) and cheese vats for processing dairy products, such as milk, whey, cheese, ice cream, sour cream, yoghurt, buttermilk, starter culture, lactose, milk protein concentrate, whey protein concentrate, whey permeate, etc., and fruit and vegetable juices, tomato paste, coffee creamer, cheese and other powders, sugars and syrups.

Table 1 discloses several exemplary food industry systems that may benefit from the present compositions and methods. Some equipment may be used to produce multiple products. It is appreciated that the examples in Table 1 are for illustration purposes only and that any surface that develop food soils may benefit from the present compositions and methods.

TABLE 1

Exemplary food industry systems that may benefit from the present compositions and methods.

| Surface (Equipment) | Product | Process | Industry |
|---|---|---|---|
| Evaporator | Condensed whole milk | Concentrating for preparation for drying or reduction in shipping costs | Dairy |
| | Condensed skim milk<br>Condensed milk protein concentrate<br>Condensed whey<br>Evaporated milk<br>Sweetened condensed milk<br>Whey protein concentrate<br>Whey permeate<br>Delactosed whey<br>Demineralized whey | | |
| Evaporator | Tomato paste | Concentrating for customer use | Vegetable |
| Evaporator | Carrot juice | Concentrating for preparation, drying or reduction in shipping costs | Juice |

TABLE 1-continued

Exemplary food industry systems that may benefit from the present compositions and methods.

| Surface (Equipment) | Product | Process | Industry |
|---|---|---|---|
| Evaporator | Syrup | Concentrating for preservative effect and customer use | Sweetener |
| | Sugar | | |
| Dryer | Whey | Making a powder for ingredients, product functionality, or reducing shipping costs | Dairy |
| | Whey protein concentrate | | |
| | Whey permeate | | |
| | Skim milk powder | | |
| | Whole milk powder | | |
| | Milk protein concentrate | | |
| | Lactose | | |
| | Coffee creamer | | |
| | Cheese powder | | |
| | Delactosed whey | | |
| | Demineralized whey | | |
| Dryer | Baby formula | Customer use | Baby formula |
| HTST and surge tank | Milk | Pasteurization | Dairy |
| | Whey | | |
| | Delactosed whey | | |
| | Demineralized whey | | |
| | Whey Control #2 filtration concentrate | | |
| | Whey permeate | | |
| | Milk protein concentrate permeate | | |
| HTST and surge tank | Orange juice | Pasteurization | Juice |
| | Fruit juices | | |
| | Carrot juice | | |
| | Vegetable juices | | |
| Batch pasteurizer, holding tank, starter media tank, mix tank, etc. | Milk | Pasteurization, inactivation of enzymes, affecting proteins for further processing, activating stabilizers, etc. | Dairy |
| | Sour cream | | |
| | Buttermilk | | |
| | Ice cream mix | | |
| | Yoghurt mix | | |
| | Starter media heating and starter culture tank | | |
| | Whey | | |
| UHT unit | Milk | Non-refrigerated convenience | Dairy |
| | Aseptically packaged UHT liquids | | |
| UHT unit | Juice | Non-refrigerated convenience | Juice |
| | Aseptically packaged UHT liquids | | |
| Cheese vats | Cheese | Curd processing | Dairy |
| Cheese curd finishing and drainage tables | Cheese | Curd processing | Dairy |
| Cheese curd matting conveyors | Cheese | Curd processing | Dairy |

TABLE 1-continued

Exemplary food industry systems that may benefit from the present compositions and methods.

| Surface (Equipment) | Product | Process | Industry |
|---|---|---|---|
| Cheese block forming towers | Cheese | Curd processing | Dairy |
| Grinders and Blenders | Meat tissue | Preparing ground product for consumer use | Red meat and poultry |
| CIP tanks (clean-in-place) | All industries | Holding and circulating cleaning chemicals | All industries |
| COP tanks (clean-out-of-place) | All industries | Utensil washing tank | All industries |
| Dolly washers, knife washer, tray washers, extension washers | All industries | General utensil washing | All industries |
| Conveyor washers | All industries | Conveys items though washer | All industries |

The present compositions may be used further in the canning, baking, meat packing, industrial rendering, vegetable packing, pet food and ethanol industries, as well as in lower heat applications that can contribute to food soil deposition. The present compositions may be used in further applications in which food soils may be deposited such as, but not limited to, fermenting, sun drying, bottling, and freeze drying.

The present compositions may be used further as a cleanser for hard surfaces, for example, in bathrooms, hospitals, sinks and countertops, food service areas.

Tables 2a-2c summarize effective ranges of embodiments of ingredients for use in the working solution. Where the total percentages of the formulations do not reach 100%, water may be used to bring the formulation to 100%.

TABLE 2a

Final Concentration of Chemicals in a Liquid Concentrate or Ready to Use Embodiment

| Components | Concentration wt/wt |
|---|---|
| Sodium or potassium hydroxide | 4.0%-50.0% |
| Sodium hypochlorite | 0.1%-8.0% |
| Thresholding agents | 0%-10% |
| Scale inhibitor or chelating agent | 0%-10% |
| Methane sulfonic acid | 0.1%-10% |
| Sodium tripolyphosphate | 0%-7.0% |
| Surfactant | 0%-5.0% |

TABLE 2b

Final Concentration of Chemicals in a Liquid Concentrate or Ready to Use Embodiment

| Components | Concentration wt/wt |
|---|---|
| Sodium or potassium hydroxide | 4.0%-50.0% |
| Sodium hypochlorite | 0.5%-8.0% |
| Thresholding Agent | 0.05%-10% |

TABLE 2b-continued

Final Concentration of Chemicals in a Liquid Concentrate or Ready to Use Embodiment

| Components | Concentration wt/wt |
|---|---|
| Scale inhibitor or chelating agent | 0.05%-10% |
| Methane sulfonic acid | 0.2%-5.0% |
| Sodium tripolyphosphate | 0.10%-7.0% |
| Surfactant | 0.25%-4.0% |

TABLE 2c

Final Concentration of Chemicals in a Liquid Concentrate or Ready to Use Embodiment

| Components | Concentration wt/wt |
|---|---|
| Sodium or potassium hydroxide | 4.0%-50.0% |
| Sodium hypochlorite | 0.5%-8.0% |
| Bayhibit AM | 0.05%-10% |
| Sodium polyacrylate | 0.05%-10% |
| Methane sulfonic acid | 0.5%-5.0% |
| Sodium tripolyphosphate | 0.10%-7.0% |
| Dowfax 2A1 | 0.25%-1.0% |

Table 3 provides examples of embodiments of ingredients for use in dry powder formulations. Columns A-F represent various iterations of dry powder formulations. It is to be appreciated that the following formulations are exemplary and that substitutions and/or additions may be tolerated without departing from the scope of the invention. For example, alkaline agents and/or hypochlorite agents may be incorporated into the following formulations or substituted for one or more components. Surfactants, defoaming agents, anti-caking agents, dyes or perfumes may also be incorporated

TABLE 3

Concentration of Chemicals in various iterations of dry formulations

| Components | Concentration of Components wt/wt | | | | | |
|---|---|---|---|---|---|---|
| | A | B | C | D | E | F |
| Sodium tripolyphosphate | 32.00% | 28.34% | 37.70% | 51.70% | 27.20% | |
| Sodium methane sulfonate | 4.00% | 4.00% | 4.00% | 4.00% | 4.00% | 4.00% |
| Sodium sulfate | | | | | | 10.80% |
| Sodium polyacrylate | | | | | | 7.30% |
| Sodium carbonate dense | 42.70% | 23.05% | 32.00% | | | 19.90% |
| Sodium metasilicate type FB | 15.00% | 38.62% | 18.80% | 33.40% | 57.90% | 50.00% |
| Sodium dichloroisocyanurate | 6.30% | 5.99% | 7.50% | 10.90% | 10.90% | 8.00% |

Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight ratio range of about 1 wt % to about 20 wt % should be interpreted to include not only the explicitly recited limits of 1 wt % and about 20 wt %, but also to include individual weights such as 2 wt %, 11 wt %, 14 wt %, and sub-ranges such as 10 wt % to 20 wt %, 5 wt % to 15 wt %, etc.

The general tendency is that the resultant formulas will have improved cleaning at lower temperatures as compared to their conventional counterparts. Cleaning is also achieved at lower concentrations of sodium hydroxide.

As used herein, Control #1 is a composition composed of the following components:

| Components | Concentration wt/wt |
|---|---|
| Water | 39.86% |
| Bayhibit N | 0.6% |
| Goodrite K7058N | 0.6% |
| Sodium hydroxide, 29% | 34.5% |
| Sodium hypochlorite, 13.5% | 24.44% |

As used herein, Control #2 is a composition composed of the following components:

| Components | Concentration wt/wt |
|---|---|
| Water | 50.72% |
| Sodium tripolyphosphate | 5.0% |
| Sodium glucoheptonate | 0.06% |
| Potassium hydroxide, 50% | 22.0% |
| Sodium hypochlorite, 13.5% | 22.22% |

As used herein, Control #3 is a composition composed of the following components:

| Components | Concentration wt/wt |
|---|---|
| Water | 16.33% |
| Bayhibit N | 1.0% |
| Goodrite K7058N | 0.6% |
| Sodium hydroxide, 29% | 24.14% |

-continued

| Components | Concentration wt/wt |
|---|---|
| Sodium glucoheptonate | 0.06% |
| Sodium hypochlorite, 13.5% | 57.87% |

As used herein Bayhibit AM™ is 100%, non-diluted 2-phosphonobutane-1,2,4-tricarboxylic acid.

As used herein, Bayhibit N™ is the sodium salt of neutralized Bayhibit AM™, or 100%, non-diluted 2-phosphonobutane-1,2,4-tricarboxylic acid tetrasodium salt.

As used herein, Goodrite K7058N™ is 100%, non-diluted sodium polyacrylate.

As used herein, Dowfax 2A1™ is a 45% use dilution of alkyl diphenyl oxide disulfonate.

EXAMPLES

The compositions and methods will be further illustrated by the following non-limiting examples, where, unless otherwise specified, ingredient amounts are reported on the basis of weight percent of the total composition. The examples herein illustrate the present invention by way of illustration, and not by limitation. The chemicals and other ingredients are presented as typical components or reactants, and various modifications may be derived in view of the foregoing disclosure within the scope of the present disclosure.

Example 1

Preparation of a Composition that Removes Food Soils

A chlorinated alkaline cleaner with methane sulfonic acid was prepared by combining the following ingredients on a weight/weight % basis: about 4.0 w/w % to about 10.0 w/w % sodium hydroxide, about 3.0 w/w % to about 8.0 w/w % sodium hypochlorite, about 0.5 w/w % to about 1.5 w/w % Bayhibit AM, about 0.3 w/w % to about 1.2 w/w % sodium polyacrylate, about 0.5 w/w % to about 3.5 w/w % methane sulfonic acid, about 9.0 w/w % to about 12.0 w/w % potassium hydroxide, about 3.0 w/w % to about 7.0 w/w % sodium tripolyphosphate, about 0.25 w/w % to about 1.0 w/w % Dowfax 2A1. The remaining weight percentage may be generally water.

The present chlorinated alkaline cleaner with methane sulfonic acid was assessed in combination with various existing detergent formulations, Control #2, Control #1 and Control #3. Surfaces are treated for 8 minutes.

Panels to be soiled are cleaned by wiping with xylene and then with iso-propanol. Panels are then dried in an oven at a temperature of between 100° C.-110° C. for between 10 to 15 minutes to ensure evaporation of the solvent. Panels are suspended in the oven by attaching a rigid wire hangar to a hole present in one end of the panel. Panels are suspended such that no contact is made with the surfaces of the oven or with other items present in the oven. Dried panels are removed from the oven and allowed to cool for a minimum of 20 minutes prior to weighing.

The initial weight of the panels is recorded using an analytical balance to the nearest 0.1 milligram.

A soiling composition is prepared by emptying evaporated milk into a 1 liter beaker along with an equivalent volume of analytical water. The mixture is stirred well to ensure homogeneity.

A maximum of three panels are placed in the milk solution by setting the an end against a side of the beaker. Approximately ¾ of the panel is immersed in the milk solution and allowed to sit in the milk for 15 minutes. After 15 minutes, panels are removed from the milk and allowed to drain in air for 5 minutes. Each side of the panel is then rinsed with 50 ml of 25 grain hard water which has been heated to between 90° F.-100° F. All soiled surfaces of the panels are rinsed with the rinse water. The rinse water is then allowed to drain off the panel. The panel is then hung in a 40° C. oven for 15 minutes to dry.

After 15 minutes in the oven the panels are removed and allowed to cool for at least 15 minutes prior to weighing. The weight of each panel is recorded to the nearest 0.1 mg.

The soil deposition, rinsing, drying, and weighing cycle is performed five times or until the soil weight falls within the range of 10-15 mg.

The milk soil cleaning test is performed using the following reagents and apparatuses:

(a) 1 liter beaker
(b) 20 ml or 100 ml graduated cylinder
(c) Hotplate/Stirrer
(d) Analytical balance weighing to the nearest 0.1 mg
(e) Laboratory oven thermostated to 100° C.-110° C.
(f) Laboratory oven thermostated to 40° C.
(g) 304SS or glass panels measuring 3"×6×0.037", having a ¼" hole in one end (available from Q-panel Co., Cleveland, Ohio)
(h) Xylene
(i) Iso-Propanol
(j) One 12 oz (354 ml) can of evaporated milk
(k) AOAC synthetic hard water of 25 grains/gallon hardness
(l) Analytical Water Table 4 summarizes the cleaning efficiency of methane sulfonic acid incorporated into existing detergent formulations. The cleaning evaluations were performed as described above, utilizing stainless steel panels "soiled" with a weighed coating of milk and cleaned via agitated immersion in a known product dilution in 3-400 ppm hardness water for eight minutes. Cleaning efficiency is measured by weight loss of soil.

TABLE 4

Cleaning Efficiency

| Sample | MSA, % | DowFax 2A1, % | OTHER | Temp, ° C. | Cleaning Results* |
|---|---|---|---|---|---|
| Control 2 | 0 | 0 | | 25 | 53.28 |
| Control 2 | 5.0 | 0 | 20% reduced alkalinity | 40 | 92.34 |
| Control 2 | 5.0 | 0 | 20% reduced alkalinity | 60 | 100 |

TABLE 4-continued

Cleaning Efficiency

| Sample | MSA, % | DowFax 2A1, % | OTHER | Temp, ° C. | Cleaning Results* |
|---|---|---|---|---|---|
| Control 1 | 5.0 | 0 | | 40 | 90 |
| Control 1 | 5.0 | 1 | | 40 | 92.7 |
| Control 1 | 1.0 | 0 | | 42 | 73.52 |
| Control 1 | 2.5 | 0 | | 42 | 82.2 |
| Control 1 | 5.0 | 0 | | 40 | 90.03 |
| Control 1 | 5.0 | 0 | | 60 | 92.95 |
| Control 1 | 5.0 | 1.0 | | 60 | 89.8 |
| Control 1 | 5.0 | 1.0 | | 25 | 88.21 |
| Control 3 | 3.0 | 0 | | 40 | 96.19 |
| Control 3 | 0 | 1.0 | | 25 | 46.70 |
| Control 3 | 1.5 | 1.0 | | 25 | 81.71 |
| Control 3 | 0.75 | 0.25 | | 25 | 81.88 |
| Control 3 | 1.5 | 0 | | 25 | 87.63 |
| Control 3 | 0.75 | 0.75 | | 25 | 89.32 |
| Control 3 | 3.0 | 1.0 | | 25 | 90.56 |
| Control 3 | 2.25 | 0.25 | | 25 | 91.09 |
| Control 3 | 3.0 | 0.5 | | 24 | 91.44 |
| Control 3 | 1.5 | 1.0 | | 26 | 91.87 |
| Control 3 | 3.0 | 1.0 | | 25 | 94.59 |
| Control 3 | 2.25 | 0.25 | | 25 | 86.31 |
| Control 3 | 2.25 | 0.15 | | 25 | 84.38 |

*Average of three independent results

Overall, addition of between 0.75% and 5.0% MSA (depending upon formulation) resulted in cleaning improvements compared to the control formula without MSA at both reduced product concentrations and operating temperatures. The neutralized MSA had no apparent effect upon chlorine or alkalinity values in stability testing.

Example 2

Cleaning Efficiency of Methane Sulfonic Acid Containing Formulations

Cleaning efficiency of methane sulfonic acid was tested. The cleaning evaluations were performed as described above, utilizing stainless steel panels "soiled" with a weighed coating of milk and cleaned via agitated immersion in a known product dilution in 300-400 ppm hardness water for eight minutes. Cleaning efficiency is measured by weight loss of soil.

Tables 5a and 5b summarize variations in component concentrations of each for test mixtures A-N. The evaluation of cleaning efficiency was carried out at 40° C. in hard water at a product concentration of 0.5% wt/wt. Table 5c summarize the results observed using compositions A-N recited in tables 5a and 5b.

TABLE 5a

Composition concentrations

| Component | A | B | C | D | E | F | G |
|---|---|---|---|---|---|---|---|
| Water | 5.04 | 4.28 | 4.53 | 5.03 | 3.53 | 4.03 | 3.53 |
| Goodrite K7058N | 0.60 | 0.60 | 0.60 | 0.60 | 0.60 | 0.60 | 0.60 |
| Bayhibit AM | 1.00 | 1.00 | 1.00 | 1.00 | 1.00 | 1.00 | 1.00 |
| Methane sulfonic acid | 1.12 | 1.5 | 1.5 | 0.75 | 2.25 | 2.25 | 2.25 |
| Dowfax 2A1 | 0.12 | 0.5 | 0.25 | 0.5 | 0.5 | 0 | 0.5 |
| Sodium hydroxide, 50% | 14.00 | 14.00 | 14.00 | 14.00 | 14.00 | 14.00 | 14.00 |
| Sodium hypochlorite, 10% | 78.12 | 78.12 | 78.12 | 78.12 | 78.12 | 78.12 | 78.12 |

TABLE 5b

| Composition concentrations | | | | | | | |
|---|---|---|---|---|---|---|---|
| Component | H | I | J | K | L | M | N |
| Water | 4.29 | 5.53 | 4.03 | 5.53 | 4.78 | 4.04 | 5.03 |
| Goodrite K7058N | 0.60 | 0.60 | 0.60 | 0.60 | 0.60 | 0.60 | 0.60 |
| Bayhibit AM | 1.00 | 1.00 | 1.00 | 1.00 | 1.00 | 1.00 | 1.00 |
| Methane sulfonic acid | 1.87 | 0.75 | 2.25 | 0.75 | 1.5 | 1.87 | 0.75 |
| Dowfax 2A1 | 0.12 | 0 | 0 | 0 | 0 | 0.37 | 0.5 |
| Sodium hydroxide, 50% | 14.00 | 14.00 | 14.00 | 14.00 | 14.00 | 14.00 | 14.00 |
| Sodium hypochlorite, 10% | 78.12 | 78.12 | 78.12 | 78.12 | 78.12 | 78.12 | 78.12 |

TABLE 5c

| Cleaning results at 40° C. | | | |
|---|---|---|---|
| SAMPLE | MSA % | Dowfax 2A1 % | Cleaning Efficiency % |
| A | 1.12 | 0.12 | 94 |
| B | 1.5 | 0.5 | 92 |
| C | 1.5 | 0.25 | 93 |
| D | 0.75 | 0.5 | 93 |
| E | 2.25 | 0.5 | 97 |
| F | 2.25 | 0 | 95 |
| G | 2.25 | 0.5 | 97 |
| H | 1.87 | 0.12 | 94 |
| I | 0.75 | 0 | 93 |
| J | 2.25 | 0 | 96 |
| K | 0.75 | 0 | 94 |
| L | 1.5 | 0 | 95 |
| M | 1.87 | 0.37 | 96 |
| N | 0.75 | 0.5 | 93 |
| Control #3 | 0 | 0 | 90 |

Table 6 summarizes test results obtained with varying formulation concentrations comprising Control #3, MSA and the surfactant Dowfax 2A1 under varying temperature conditions.

TABLE 6

| Cleaning efficiency of varying formula iterations* | | | | | |
|---|---|---|---|---|---|
| Sample | MSA, % | Dowfax 2A1, % | Temp, ° C. | Conc. | Cleaning Eff. |
| Control #3 | 0 | 0 | 25 | 0.75 | 58 |
| Control Control #3 | 0 | 0.5 | 25 | 0.75 | 61 |
| Control #3 | 0 | 1 | 25 | 0.75 | 64 |

TABLE 6-continued

| Cleaning efficiency of varying formula iterations* | | | | | |
|---|---|---|---|---|---|
| Sample | MSA, % | Dowfax 2A1, % | Temp, ° C. | Conc. | Cleaning Eff. |
| Control #3 | 0.75 | 0.25 | 25 | 0.75 | 81 |
| Control #3 | 0.75 | 0.75 | 25 | 0.75 | 85 |
| Control #3 | 2.25 | 0.25 | 25 | 0.75 | 86 |
| Control #3 | 3 | 0 | 25 | 0.75 | 88 |
| Control #3 | 3 | 0 | 25 | 0.75 | 89 |
| Control #3 | 1.5 | 0 | 25 | 0.75 | 89 |
| Control #3 | 1.5 | 1 | 25 | 0.75 | 90 |
| Control #3 | 1.5 | 1 | 25 | 0.75 | 91 |
| Control #3 | 3 | 0.5 | 25 | 0.75 | 93 |
| Control #3 | 3 | 1 | 25 | 0.75 | 94 |
| Control #3 | 3 | 1 | 25 | 0.75 | 94 |

*Percentage adjustments were made by removing the equivalent percentage of H2O

Example 3

Preparation of a Composition that Removes Food Soils

Effects on Static Foam Generation

Beyond physical stability, the critical performance criteria to be measured with a pipeline cleaner are cleaning and foam generation. Foaming is tested both statically and dynamically. In the case of the formulations tested, the Dowfax 2A1/MSA formulas showed some limitation on the amount of Dowfax 2A1 that could be incorporated while still retaining acceptably low foam levels. None of the MSA-only formulations showed any foam and were, therefore, equal to the current formula of Control #3. (This was also the case with MSA used in the Control #1 and Control #2 formulations.)

The static foam test is performed by preparing a recommended use dilution for the product to be tested. 100 mls of the use dilution is decanted into a 250 ml glass stoppered graduated cylinder. The graduated cylinder is stoppered and agitated by inversion and by rotating the cylinder about its midpoint without translational motion for 1 minute. Around 30 inversions are completed. The cylinder is then placed in an upright position on a table for analysis. The net volume of foam (total volume minus the volume of liquid) is then determined initially and after 1, 5 and 30 minutes.

The static foam test is carried out using the following equipment:

(a) 250 ml glass stoppered graduated cylinder
(b) Triple beam balance
(c) Distilled Water Table 7 summarizes the results of variations on chemical compositions on the generation of static foam during cleaning.

TABLE 7

| Control #3 Compositions and Foam Generation Results | | | | | | | | | | | |
|---|---|---|---|---|---|---|---|---|---|---|---|
| | | | | | | Static Foam | | | | | |
| | | | | Temp., | Cleaning | 1 min | | 5 min | | 30 min | |
| Sample | MSA % | 2A1 % | Other | ° C. | Efficiency % | 0.50% | 1.00% | 0.50% | 1.00% | 0.50% | 1.00% |
| Control #3 | 2.25 | 0.25 | | 25 | 86.31 | 2 mL | 4 mL | 2 mL | 2 mL | 0 ml | 0 ml |
| Control #3 | 2.25 | 0.15 | | 25 | 84.38 | 0 ml | 0 ml | 0 ml | 0 ml | 0 ml | 0 ml |
| Control #3 | 2.25 | 0.1 | | 25 | 61.69 | 0 ml | 0 ml | 0 ml | 0 ml | 0 ml | 0 ml |
| Control #3 | 2.25 | 0.05 | | 25 | 53.68 | 0 ml | 0 ml | 0 ml | 0 ml | 0 ml | 0 ml |

TABLE 7-continued

Control #3 Compositions and Foam Generation Results

| Sample | MSA % | 2A1 % | Other | Temp., ° C. | Cleaning Efficiency % | Static Foam 1 min 0.50% | 1 min 1.00% | 5 min 0.50% | 5 min 1.00% | 30 min 0.50% | 30 min 1.00% |
|---|---|---|---|---|---|---|---|---|---|---|---|
| Control #3 | 2.25 | 0.25 | NaOH reduced 25% | 25 | 64.86 | 2 mL | 4 mL | 2 mL | 2 mL | 0 ml | 0 ml |
| Control #3 | 2.25 | 0.25 | NaOH reduced 30% | 25 | 62.63 | 2 mL | 4 mL | 2 mL | 2 mL | 0 ml | 0 ml |
| Control #3 | 2.25 | 0.25 | NaOH reduced 35% | 25 | 69.87 | 2 mL | 4 mL | 2 mL | 2 mL | 0 ml | 0 ml |
| Control #3 | 2.25 | 0.25 | NaOH reduced 40% | 25 | 72.30 | 2 mL | 4 mL | 2 mL | 2 mL | 0 ml | 0 ml |
| Control #3 | 2.25 | 0.15 | NaOH reduced 25% | 25 | 84.08 | 0 ml | 2 mL | 0 ml | 0 ml | 0 ml | 0 ml |
| Control #3 | 2.25 | 0.15 | NaOH reduced 30% | 26 | 84.79 | 0 ml | 2 mL | 0 ml | 0 ml | 0 ml | 0 ml |
| Control #3 | 2.25 | 0.15 | NaOH reduced 35% | 25 | 84.24 | 0 ml | 2 mL | 0 ml | 0 ml | 0 ml | 0 ml |
| Control #3 | 2.25 | 0.15 | NaOH reduced 40% | 24 | 86.62 | 0 ml | 2 mL | 0 ml | 0 ml | 0 ml | 0 ml |

Example 4

Preparation of a Composition that Removes Food Soils

Effects on Dynamic Foam Generation

The dynamic foam test is performed by connecting tubing from the outlet of an air pump through the bottom of a flowrator tube. The tubing is further arranged out through the top of the flowrator tube and onto the inlet of a 1 inch diameter ceramic ball-style airstone. Specifically, the airstone is a 2.5 cm spherical aluminum oxide gas diffuser stone manufactured by Saint Gobain Performance Plastics. The air pump is activated and the flow rate is set to 1.5 liters per minute. After pumping, the pump is deactivated. A recommended use dilution is prepared for the product to be tested. 100 mls of the use dilution is decanted into the graduated cylinder and capped off. The air pump is activated for exactly 15 seconds and then deactivated. Both the net volume of foam (total volume minus the volume of liquid) and the time for complete foam collapse after deactivation of the apparatus is recorded. A value of zero for time until foam collapse means that the collapse was instantaneous.

The dynamic foam test is carried out using the following equipment:

(a) Air Pump GE Model 5KH32EG115X (or equivalent)
(b) Gilmont model GF-1260 Flowrator Tube
(c) 1 Liter graduated cylinder
(d) Rubber tubing
(e) Stopwatch
(f) Distilled Water Tables 8a-8c summarizes the results of variations on chemical compositions on the generation of dynamic foam during cleaning.

TABLE 8a

Dynamic foam test results at a 0.75% composition concentration

| Sample | MSA % | Dowfax 2A1 % | Results at 25° C. Initial Foam, ml | Results at 25° C. Time until Foam Collapse, min | Results at 40° C. Initial Foam, ml | Results at 40° C. Time until Foam Collapse, min |
|---|---|---|---|---|---|---|
| Control #3 | 0.0 | 0.0 | 0.0 | 0.0 | 0.0 | 0.0 |
| Control #3 | 1.5 | 0.0 | 0.0 | 0.0 | 0.0 | 0.0 |
| Control #3 | 3.0 | 0.0 | 0.0 | 0.0 | 0.0 | 0.0 |
| Control #3 | 3.0 | 1.0 | 0.0 | 0.0 | 190.0 | 20.0 |
| Control #3 | 0.75 | 0.25 | 70.0 | 1.0 | 80.0 | 0.25 |
| Control #3 | 2.25 | 0.25 | 80.0 | 1.0 | 90.0 | 0.75 |
| Control #3 | 0.0 | 0.5 | 100.0 | 7.0 | 120.0 | 1.0 |
| Control #3 | 3.0 | 0.5 | 100.0 | 14.0 | 120.0 | 1.0 |
| Control #3 | 0.0 | 1.0 | 110.0 | 15.0 | 200.0 | 20.0 |
| Control #3 | 1.5 | 1.0 | 80.0 | 10.0 | 190.0 | 20.0 |
| Control #3 | 0.75 | 0.75 | 70.0 | 10.0 | 100.0 | 4.0 |

TABLE 8b

| Dynamic foam test results at a 0.5% composition concentration | | | | | | |
|---|---|---|---|---|---|---|
| | | | Results at 40° C. | | Results at 60° C. | |
| Sample | MSA % | Dowfax 2A1 % | Initial Foam, ml | Time until Foam Collapse, min | Initial Foam, ml | Time until Foam Collapse, min |
| Control #3 | 0.0 | 0.0 | 0.0 | 0.0 | 0.0 | 0.0 |
| Control #3 | 1.5 | 0.0 | 0.0 | 0.0 | 0.0 | 0.0 |
| Control #3 | 3.0 | 0.0 | 0.0 | 0.0 | 0.0 | 0.0 |
| Control #3 | 0.75 | 0.25 | 70.0 | 0.33 | 90.0 | 0.25 |
| Control #3 | 2.25 | 0.25 | 70.0 | 0.05 | 100.0 | 0.25 |
| Control #3 | 0.75 | 0.75 | 100.0 | 0.5 | 170 | 2.0 |
| Control #3 | 0.0 | 0.5 | 110.0 | .25 | 190.0 | 0.5 |
| Control #3 | 3.0 | 0.5 | 120.0 | 0.12 | 200.0 | 0.75 |
| Control #3 | 0.0 | 1.0 | 150.0 | 3.0 | 190.0 | 6.0 |
| Control #3 | 1.5 | 1.0 | 150.0 | 3.0 | 200.0 | 6.0 |
| Control #3 | 3.0 | 1.0 | 180.0 | 3.0 | 200.0 | 6.0 |

TABLE 8c

| Dynamic foam test results at a 0.3% composition concentration | | | | | | |
|---|---|---|---|---|---|---|
| | | | Results at 40° C. | | Results at 60° C. | |
| Sample | MSA % | Dowfax2A1 % | Initial Foam, ml | Time until Foam Collapse, min | Initial Foam, ml | Time until Foam Collapse, min |
| Control #3 | 0.0 | 0.0 | 0.0 | 0.0 | 0.0 | 0.0 |
| Control #3 | 1.5 | 0.0 | 0.0 | 0.0 | 0.0 | 0.0 |
| Control #3 | 3.0 | 0.0 | 0.0 | 0.0 | 0.0 | 0.0 |
| Control #3 | 0.75 | 0.25 | 50.0 | 0.05 | 80.0 | 0.17 |
| Control #3 | 2.25 | 0.25 | 50.0 | 0.05 | 90.0 | 0.17 |
| Control #3 | 0.75 | 0.75 | 90.0 | 0.08 | 110.0 | 0.17 |
| Control #3 | 0.0 | 0.5 | 100.0 | 0.08 | 110.0 | 0.17 |
| Control #3 | 3.0 | 0.5 | 110.0 | 0.12 | 110.0 | 0.17 |
| Control #3 | 3.0 | 1.0 | 120.0 | 0.08 | 140.0 | 0.42 |
| Control #3 | 0.0 | 1.0 | 130.0 | 0.08 | 150.0 | 0.17 |
| Control #3 | 1.5 | 1.0 | 130.0 | 0.08 | 190.0 | 0.17 |

Example 5

Preparation of a Composition that Removes Food Soils

Chlorine Stability

The chlorine stability test is performed by placing 80 ml of a formulation into a 120 ml glass bottle. The bottle is sealed and stored at room temperature, between 20° C. to 25° C. in the absence of sunlight for up to one month. The percentage of chlorine in the formulation is determined at the time of manufacture, 2 weeks after manufacture and 1 month after manufacture.

Table 9 summarizes the results of chlorine stability in the presence of MSA and various formulations. Chlorine stability is assessed by the remaining percentage of chlorine in a formulation over time.

TABLE 9

| Chlorine stability of various formulations | | | | | |
|---|---|---|---|---|---|
| Formulations | | | Results chlorine % at | Results chlorine % 2 | Results chlorine % 1 |
| | Dowfax 2A1 % | MSA, % | time of manufacture | weeks after manufacture | month after manufacture |
| Control #3 | 0.0 | 3.0 | 7.95 | 7.95 | 6.78 |
| Control #3 | 1.0 | 0.0 | 7.97 | 7.25 | 6.85 |
| Control #2 | 0.0 | 5.0 | 3.2 | 2.9 | 2.8 |

Those skilled in the art will appreciate that the foregoing discussion teaches by way of example, and not by limitation. Insubstantial changes may be imposed upon the specific embodiments described here without departing from the scope and spirit of the invention.

What is claimed:

1. In an improved multifunctional cleaning composition for removing food soils, the improvement comprising:

(i) from about 0.2% to about 10.0% by weight of the composition including methanesulfonic acid or alkali metal salt thereof;

(ii) from about 0.1% to about 8.0% by weight of the composition including a hypochlorite;

(iii) an effective amount of an alkaline agent to adjust solution pH to greater than 8; and (iv) at least one material selected from the group consisting of threshold inhibiting agents, scale inhibitors, chelating agents, and tripolyphosphates, wherein said composition exhibits an initial foam volume of less than about 200 mL following a dynamic foam test in which 100 mL of a 0.5% (v/v) use dilution of said composition is placed inside a 1 liter graduated cylinder that contains a 2.5 cm spherical aluminum oxide gas diffuser and subjected to a flow of air through the diffuser at a flow rate of 1.5 liters per minute for 15 seconds.

2. The multifunctional cleaning composition of claim 1 wherein the one or more of a hypochlorite is selected from the group consisting of sodium hypochlorite, potassium hypochlorite, and combinations thereof.

3. The multifunctional cleaning composition of claim 1 wherein the alkaline agent is selected from the group consisting of sodium hydroxide, potassium hydroxide, and combinations thereof.

4. The multifunctional cleaning composition of claim 1 further comprising:

from about 0.25% to about 1.0% by weight of one or more surfactants.

5. The multifunctional cleaning composition of claim 1 wherein the composition is in the form of a powder, liquid, gel or slurry.

6. An improved method for removing food soils, the improvement comprising treating a surface with a composition, wherein the composition includes:

(i) from about 0.2% to about 10.0% by weight of methanesulfonic acid or alkali metal salt thereof;

(ii) from about 0.5% to about 8.0% by weight of one or more of a hypochlorite;

(iii) an effective amount of an alkaline agent to adjust solution pH to greater than 8; and (iv) at least one material selected from the group consisting of threshold inhibiting agents, scale inhibitors, chelating agents, and tripolyphosphates, wherein said composition exhibits an initial foam volume of less than about 200 mL following a dynamic foam test in which 100 mL of a 0.5% (v/v) use dilution of said composition is placed inside a 1 liter graduated cylinder that contains a 2.5 cm spherical aluminum oxide gas diffuser and subjected to a flow of air through the diffuser at a flow rate of 1.5 liters per minute for 15 seconds.

7. The method of claim 6 wherein the treating occurs within a temperature range between about 5° C. and about 90° C.

8. The method of claim 6 wherein less than about 5 ml of foam is generated per about 100 mls of a solution.

9. The method of claim 6 wherein foam collapses within less than about 1 minute of foam generation.

10. The method of claim 6 further comprising selecting one or more of the hypochlorite from the group consisting of sodium hypochlorite, potassium hypochlorite, and combinations thereof.

11. The method of claim 6 further comprising selecting the alkaline agent from the group consisting of sodium hydroxide, potassium hydroxide and combinations thereof.

12. The method of claim 6 further comprising: from about 0.25% to about 1.0% by weight of one or more surfactants.

13. A method of making a multifunctional cleaning composition for removing and/or inhibiting formation of precipitates comprising combining:

(i) from about 0.2% to about 10.0% by weight of the composition including methanesulfonic acid or alkali metal salt thereof;

(ii) from about 0.1% to about 8.0% by weight of the composition including a hypochlorite material;

(iii) an effective amount of an alkaline agent to adjust solution pH to greater than 8; and (iv) at least one material selected from the group consisting of threshold inhibiting agents, scale inhibitors, chelating agents, and tripolyphosphates, wherein said composition exhibits an initial foam volume of less than about 200 mL following a dynamic foam test in which 100 mL of a 0.5% (v/v) use dilution of said composition is placed inside a 1 liter graduated cylinder that contains a 2.5 cm spherical aluminum oxide gas diffuser and subjected to a flow of air through the diffuser at a flow rate of 1.5 liters per minute for 15 seconds.

14. The method of claim 13 further comprising including the hypochlorite selected from the group consisting of sodium hypochlorite, potassium hypochlorite, and combinations thereof.

15. The method of claim 13 further comprising including the alkaline agent selected from the group consisting or sodium hydroxide, potassium hydroxide, and combinations thereof.

16. The method of claim 13 further comprising: from about 0.25% to about 1.0% by weight of one or more surfactants.

17. The method of claim 13 further comprising formulating the composition as a powder, liquid, gel or slurry.

18. The method of claim 13 further comprising adjusting a pH of the solution to between about pH 8 to about pH 13 with the alkaline agent.

19. The multifunctional cleaning composition of claim 1, wherein said material comprises at least one member selected from the group consisting of:

(a) from about 0.05% to about 10.0% by weight of one or more of said threshold inhibiting agents;

(b) from about 0.05% to about 10.0% by weight of one or more of said scale inhibitors;

(c) from about 0.05% to about 10.0% by weight of one or more of said chelating agents; and (d) from about 0.10% to about 7.0% by weight one or more of said tripolyphosphates.

20. The method of claim 6, wherein said material comprises at least one member selected from the group consisting of:

(a) from about 0.05% to about 10.0% by weight of one or more of said threshold inhibiting agents;

(b) from about 0.05% to about 10.0% by weight of one or more of said scale inhibitors;

(c) from about 0.05% to about 10.0% by weight of one or more of said chelating agents; and (d) from about 0.10% to about 7.0% by weight one or more of said tripolyphosphates.

21. The method of claim 13, wherein said material comprises at least one member selected from the group consisting of:

(a) from about 0.05% to about 10.0% by weight of one or more of said threshold inhibiting agents;

(b) from about 0.05% to about 10.0% by weight of one or more of said scale inhibitors;

(c) from about 0.05% to about 10.0% by weight of one or more of said chelating agents; and (d) from about 0.10% to about 7.0% by weight one or more of said tripolyphosphates.

22. The multifunctional cleaning composition of claim 1 further comprising an effective amount of an alkaline agent to adjust the solution pH to greater than about 10.

23. The method of claim 6, wherein said material further comprises an effective amount of an alkaline agent to adjust the solution pH to greater than about 10.

24. The method of claim 13, wherein said material further comprises an effective amount of an alkaline agent to adjust the solution pH to greater than about 10.

25. A use dilution composition comprising between about 0.1% to about 2.0% by weight of said cleaning composition of claim 1 dispersed in a solvent.

26. The use dilution composition of claim 25, wherein said use dilution composition comprises between about 0.25% to about 0.75% by weight of said cleaning composition dispersed in said solvent.

* * * * *